US006619024B1

(12) United States Patent
Strobel et al.

(10) Patent No.: US 6,619,024 B1
(45) Date of Patent: Sep. 16, 2003

(54) JEWELRY LINK FORMING APPARATUS

(76) Inventors: Kalman Strobel, 131 W. 35th St., New York, NY (US) 10001; Stanley Szurlej, 131 W. 35th St., New York, NY (US) 10001

( * ) Notice: Subject to any disclaimer, the term of this patent is extended or adjusted under 35 U.S.C. 154(b) by 0 days.

(21) Appl. No.: 10/314,211

(22) Filed: Dec. 9, 2002

Related U.S. Application Data

(60) Provisional application No. 60/379,162, filed on May 8, 2002.

(51) Int. Cl.[7] ..... B21L 5/02; B21L 17/00

(52) U.S. Cl. ..... 59/35.1; 59/23; 59/80; 59/82

(58) Field of Search ..... 59/35.1, 80, 82, 59/3, 20, 23, 25, 27

(56) References Cited

U.S. PATENT DOCUMENTS

| | | | | | |
|---|---|---|---|---|---|
| 979,110 | A | * | 12/1910 | Ungerer et al. | 59/35.1 |
| 4,503,664 | A | | 3/1985 | Allazzetta | 59/16 |
| 5,125,225 | A | | 6/1992 | Strobel | 59/35.1 |
| 5,129,220 | A | | 7/1992 | Strobel | 59/80 |
| 5,353,584 | A | | 10/1994 | Strobel | 59/80 |
| 5,408,820 | A | | 4/1995 | Strobel | 59/80 |
| 5,412,935 | A | | 5/1995 | Rozenwasser | 59/80 |
| 5,437,149 | A | | 8/1995 | Strobel | 59/80 |
| 5,487,264 | A | | 1/1996 | Strobel | 59/80 |
| 5,526,639 | A | | 6/1996 | Gonzales | 59/35.1 |
| 5,531,065 | A | | 7/1996 | Rozenwasser | 59/80 |
| 5,537,812 | A | | 7/1996 | Rozenwasser | 59/80 |
| 5,581,993 | A | | 12/1996 | Strobel | 59/35.1 |
| 5,660,036 | A | | 8/1997 | Rozenwasser | 59/80 |
| 5,737,910 | A | | 4/1998 | Rozenwasser | 59/35 |
| 5,755,088 | A | | 5/1998 | Farsetti | 59/35.1 |
| 5,775,088 | A | * | 7/1998 | Grosz | 59/23 |
| 5,797,258 | A | | 8/1998 | Strobel | 59/35.1 |
| 5,799,480 | A | | 9/1998 | Cerato | 59/30 |
| 6,105,357 | A | | 8/2000 | Weinberg | 59/35.1 |
| 6,209,306 | B1 | | 4/2001 | Chia | 59/80 |
| 6,460,323 | B1 | | 10/2002 | Rosenwasser | 59/80 |
| 6,553,751 | B2 | * | 4/2003 | Weinberg | 59/35.1 |

* cited by examiner

*Primary Examiner*—David Jones
(74) *Attorney, Agent, or Firm*—Alfred M. Walker

(57) ABSTRACT

A jewelry link made from square crossectional metal wire has a C-shape when the link is bent within a specially configured clamp over a mandrel, wherein the formed C-shaped links are diamond shaped in cross section. The links further have an outer circumference at their widest point formed by one of the four corner seams of a hollow or solid square wire, which is rotated 45 degrees onto one of its straight longitudinally extending edges before being bent around a mandrel. In that manner, the link is considerably wider than a link formed from square wire which is wrapped upon one of its surfaces over a mandrel.

19 Claims, 4 Drawing Sheets

JEWELRY LINK FORMING APPARATUS

RELATED APPLICATIONS

This application is based in part upon Provisional Application No. 60/379,162, filed May 8, 2002, which is incorporated by reference herein.

FIELD OF THE INVENTION

The present invention relates to optimal width jewelry links For jewelry pieces, such as necklaces and the like.

BACKGROUND OF THE INVENTION

In the jewelry industry the fabrication of chains, including rope chains, from individual C-shaped wire links is well known. The process is either manual or machine automated. The available technology can automatically form the wire links from a continuous supply of wire of a variety of crossectional shapes, such as round, square, or triangular.

However, the wire is bent around a mandrel and further formed with dies such that, except for round crossection wire, the C-shaped links always have a flat side that wraps around the mandrel, thus forming the inside diameter of a link to be formed from the wire.

This limits the width of the wire to the diameter of the cylindrical wire, or to the width of one edge of a square wire.

OBJECTS OF THE INVENTION

It is therefore a desirable object of the present invention to be able to form C-shaped jewelry links, from square crossectional wire, with a diamond shaped geometry, wherein an edge of the wire is wrapped around the mandrel, thus forming a C-shaped link whereby two distinct facet surfaces are visible from a top view.

Other objects which become apparent from the following description of the present invention.

SUMMARY OF THE INVENTION

In keeping with these objects and others, which may become apparent, the present invention includes machinery and a method for producing a wide C-shaped jewelry link, as well as the C-shaped link product produced thereby.

The crossection of the link-forming wire, which is orthogonal to the plane of the link, is then diamond shaped, with the widest points of the link corresponding to the wide common hypotenuse joining the two equilateral triangles, which forms the diamond cossectional width of the C-shaped link.

Thus the C-shaped links of the present invention appear to have been formed from a wire material having a width, which is 41% wider, than one wrapped from the same wire, using a flat surface against the forming mandrel. The C-shaped links thus formed also have two reflecting surfaces, when viewed from a top view.

To achieve this result, both the mandrel as well as the forming dies are grooved, in order to hold the square wire on one of its edges, during the wrapping and forming operations.

Although not absolutely essential, an optional spring-mounted mandrel is used to automatically pop off the finished C-shaped link from its alignment groove, prior to removal for further automated or manual assembly into the desired chain.

Many methods for dealing with the gap at the distal ends of a C-shaped link, as for prior art chains are applicable. One technique involves bonding two links together in pairs after they have engaged the desired number of other double link pairs.

Therefore, the present invention includes a method and a machine for forming a wide C-shaped link from a square wire having corners, forming a diamond shape when viewed in cross section, for use in making a jewelry chain. The machine includes a means for feeding the wire in and along a V-shaped groove formed in a surface of a stationary die, wherein the V-shaped groove is adapted to accommodate a first corner of the wire. The machine also includes a cutter for cutting the wire, to form a discrete wire section, with a predetermined length of the wire in the V-shaped groove, wherein the surface of the die has a concave forming surface between ends of the predetermined length of the wire.

The concave forming surface has a shape including a corner to correspond with the first corner of the wire in the V-shaped groove. A mandrel has a guidance groove matching a second corner of the wire, on an opposite side of the wire from the first corner, for pushing and bending the wire into the concave forming surface to form the wire into a U-shaped configuration. A pair of movable die sections close the wire, to form a C-shaped link surrounding the mandrel and the movable die sections have die V-shaped grooved surfaces, which are shaped to correspond to the first corner of the wire, thereby forming a C-shaped link of the wire, in which the second corner forms an inner circumference of the C-shaped link and the first corner forms an outer circumference of the C-shaped link.

The wire is square in cross section so that the C-shaped link is diamond-shaped, with optional facets, when viewed in crossection.

The wire may be a polygon, when viewed in crossection so that said C-shaped link is diamond shaped with facets.

The machine also includes an optional apparatus for removing a C-shaped link from a mandrel circular in crossection, the C-shaped link being in a groove surrounding the mandrel. This optional apparatus has a mandrel housing, having a blind hole in an end wall, to receive one end of the mandrel. This blind hole has a diameter, which is large enough to receive a first end of the mandrel, and which is not large enough to accommodate the C-shaped link on the mandrel. A pin is provided at right angles to a length of the mandrel for contacting an end of the mandrel within the hole, when the mandrel is inserted into the hole. A spring is provided within the hole, and it contacts a side of the pin, which is opposite to a side in contact with the first end of the mandrel. An anvil forces the first end of the mandrel against the pin compressing the spring, causing the end wall of the mandrel housing to pop the C-shaped link out of the groove in the mandrel. The spring at least partially ejects the mandrel from the blind hole when the anvil is retracted away from the mandrel.

A gripper mechanism is provided to remove the C-shaped link from a second end of the mandrel, after the C-shaped link is removed from the groove in the mandrel.

A length extending from the groove to the second end of the mandrel is sufficiently short as to allow the C-shaped link, when popped out of the groove in the mandrel, to drop into a container for collecting the C-shaped link.

In operation, a method is provided of making a jewelry chain from C-shaped links formed from a wire having corners in cross section, wherein the method comprises-the steps of:

a) feeding the wire in and along a V-shaped groove formed in a surface of a stationary die, the V-shaped groove being adapted to accommodate a first corner of the wire;

b) cutting the wire to form a predetermined length of the wire in the V-shaped groove, the surface of the die having a concave forming surface between ends of the predetermined length of the wire, the concave forming surface having a shape, including a corner, to correspond with the first corner of the wire in the V-shaped groove;

c) pushing and bending the wire into the concave forming surface, using a mandrel, having a guidance groove matching a second corner of the wire, on an opposite side of the wire from the first corner, to form the wire into a preliminary U-shaped configuration;

d) closing the wire to form a C-shaped link surrounding the mandrel, using a pair of movable die sections, the movable die sections having die V-shaped grooved surfaces, which are shaped to correspond to the first corner of the wire, thereby forming a C-shaped link of the wire, in which the second corner forms an inner circumference of the C-shaped link and the first corner forms an outer circumference of the C-shaped link;

e) removing the C-shaped link from the mandrel;

f) moving successive wire segments along the V-shaped groove formed in the surface of the stationary die to produce a plurality of C-shaped links from the same wire; and g) combining the C-shaped links to form a jewelry chain.

The operation also includes a method of removing a C-shaped link from a mandrel, which is circular in cross section, wherein the C-shaped link is in a groove surrounding the mandrel, which removal operation includes the steps of:

a) inserting one end of the mandrel into a hole in an end wall of a mandrel housing, the hole having a diameter large enough to receive the mandrel and not large enough to accommodate the C-shaped link on the mandrel, wherein a pin is within the hole at right angles to a length of the mandrel for contacting an end of the mandrel within the hole, when the mandrel is inserted into the hole, and a spring is within the hole contacting a side of the pin opposite to a side in contact with the mandrel;

b) using an anvil to push the mandrel against the pin, compressing the spring and causing the end wall of the mandrel housing to pop the C-shaped link out of the groove in the mandrel, wherein the spring at least partially ejects the mandrel from the hole when the anvil is retracted; and c) removing the C-shaped link from one end of the mandrel.

The method of the operation also includes removing the C-shaped link from the mandrel, by using a gripper, to grab the C-shaped link and moving the C-shaped link past an end of the mandrel.

Finally, the C-shaped link is removed from the mandrel by dropping off one end of the mandrel when the C-shaped link is popped out of the groove, which results in a fine jewelry link having a wide diamond-shaped crossection, without the need for expensive grinding or embossing to form the diamond-shaped configuration of the crossection of the formed C-shaped link.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

This invention describes the detailed modifications of the forming mechanism required to produce C-shaped links, having a diamond-shaped crossection, from square wire. The modified forming mechanisms are then integrated into prior art machinery to produce the C-shaped links of this invention and optionally to use these C-shaped links, to form linear or rope chain in an automated process.

Figure 1:
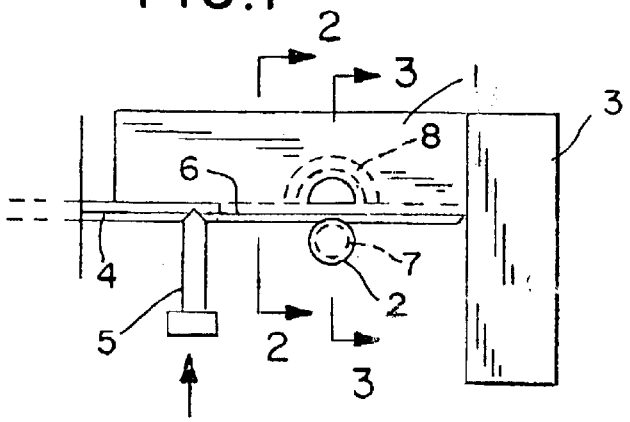
FIG. 1 is an End view of the wire cutting phase in the jewelry link forming process.

FIG. 1 shows the cutting phase of wire 4. Prior to cutting, wire 4, in the proper crossectional orientation, is pushed to the right guided by V-shaped groove 6 along the bottom edge of fixed die 1 and between the gap above mandrel 2 with guidance V-shaped groove 7. Wire 4 is advanced until stopped by the side frame member 3. Then cutter 5 is cycled upward to cut wire 4 into a discrete section.

Figure 2:
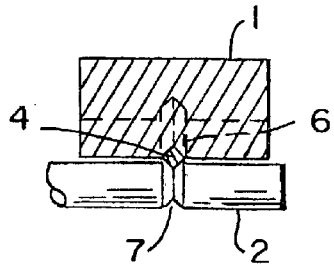
FIG. 2 is a Crossectional view showing the holding groove long bottom of fixed die as well as a mandrel groove.
Figure 3:
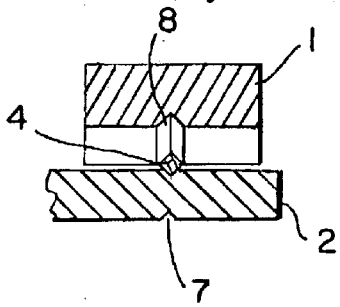
FIG. 3 is a Crossectional view showing the internal groove in a fixed forming die.

Inside contour 8 of fixed forming die 1 can be better understood by the crossection views of FIGS. 2 and 3. The depth of mandrel groove 7 is exaggerated for clarity.

Figure 4:
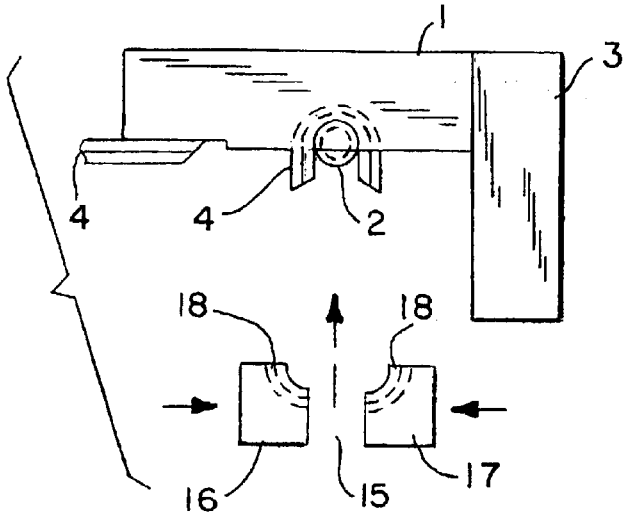
FIG. 4 is an End view showing a preliminary U-shaped partially formed C-shaped link, just prior to forming into a final C-shaped link, by movable dies.

FIG. 4 is an end view showing the phase of c-link formation after mandrel 2 is moved upward into the recess of fixed die 1, thereby forming the length of wire 4 into the U-shape shown.

Figure 5:
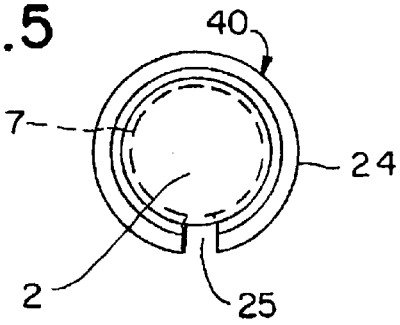
FIG. 5 is an End view of the C-shaped link wrapped around a mandrel after forming.

At this point, cam mechanisms (not shown) move movable die 15, with sections 16 and 17, upward and sideways, to close the ends of the U-shape link into finished C-shaped link 40, as shown in FIG. 5.

Movable die sections 16 and 17 have grooved recesses 18 to support wire 4 in the proper orientation. C-shaped link 40 has gap 25 and outer edge 24, which is a vertex of the diamond crossection.

Figure 6:
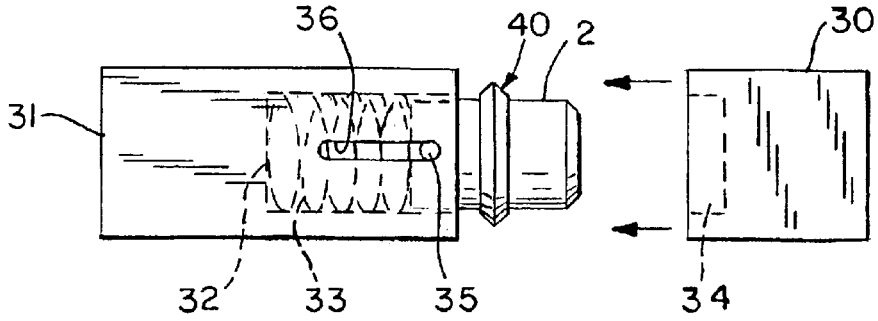
FIG. 6 is a Side elevational view of the C-shaped link on the forming mandrel prior to a strike by an anvil.
Figure 7:
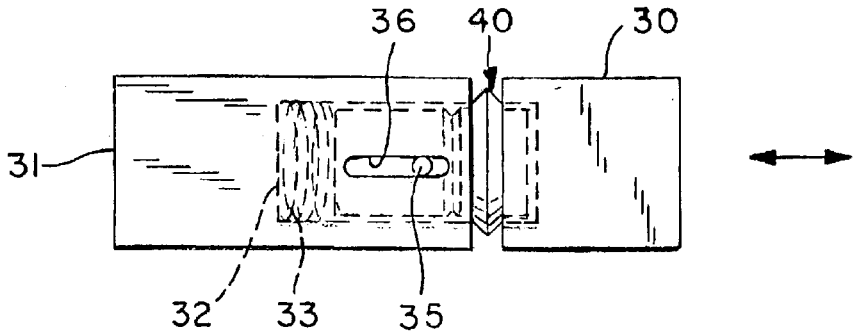
FIG. 7 is a Side elevational view of the moved C-shaped link on the mandrel, at the end of the strike by the anvil.
Figure 8:
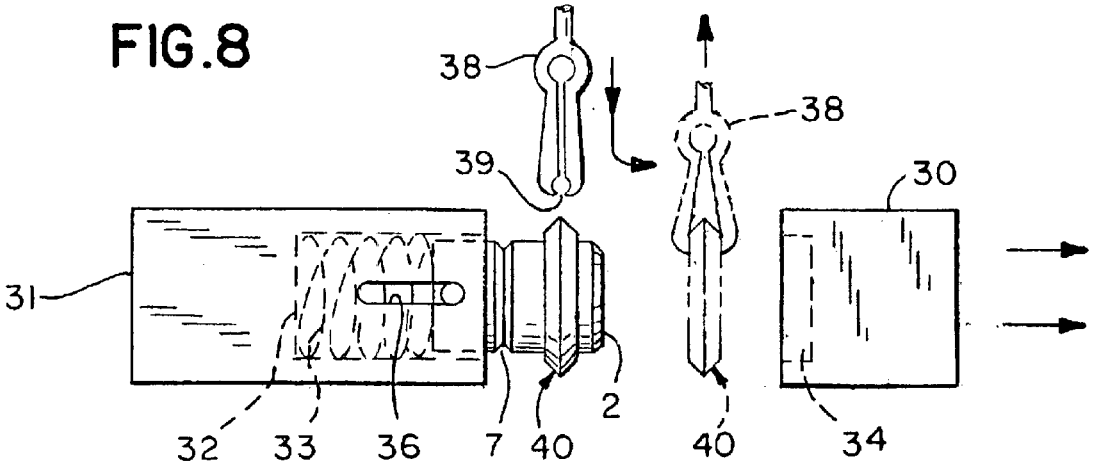
FIG. 8 is a Side elevational view of the C-shaped link on the mandrel, after withdrawal of the anvil, with subsequent movement of the gripper, wherein the moved gripper and link are shown in phantom lines.

FIGS. 6, 7 and 8 are a sequence of side views which show further automated steps in the process after C-shaped link 40 is formed. Alternate embodiments with mechanisms not using a retractable mandrel as shown in FIGS. 6, 7 and 8 are also possible, if a very shallow V-shaped groove 7 is used to guide wire 4 during forming. Mandrel housing 31 has a blind end hole 32 which houses spring 33, forcing a retractable mandrel 2 out to its normal position as set by pin 35, riding in slot 36. Anvil 30 with recess 34 can be moved laterally, from the resting position of FIG. 6, to its full impact position of FIG. 7. The impact dislodges C-shaped link 40 from groove 7 on mandrel 2 and simultaneously flattens C-shaped link 40 against the flat end faces of housing 31 and anvil 30 to remove any inadvertent twisting.

After anvil 30 is withdrawn as shown in FIG. 8, C-shaped link 40 has been moved closer to the end of mandrel 2 and gripper 38 (with articulated arms or spring actuated arms as shown) is descending, to engage C-shaped link 40, with grooved end 39, to continue an automated fabrication process, by removing C-shaped link 40 from the end of mandrel 2. The moved gripper 38 and C-shaped link 40 is shown in phantom lines in FIG. 8.

In an alternate system to just form C-shaped links 40 for manual fabrication, or to feed in bulk to a separate automated machine, C-shaped links 40 can be simply ejected into a bin, after the step of FIG. 8, by a slight modification of anvil 30. Instead of recess 34, a short rounded protrusion from the end face of anvil 30 is used. This protrusion will move mandrel 2 farther into housing 31, thereby dislodging C-shaped link 40 from the end of mandrel 2, at the impact step shown in FIG. 7. C-shaped link 40 then just falls into a receiving bin when modified mandrel 30 is withdrawn.

Many different types of chains can be made with C-shaped links 40. While gap 25 of C-shaped link 40 permits one link to engage another, different methods are used to deny the unlinking, such as by squeezing each C-shaped link 40 to reduce gap 25. Also, although depicted as having a large inner diameter relative to the circumference, a wide variety of crossection width to link diameters are possible as desired. One locking technique involves the bonding of C-shaped links 40 in pairs after the desired number of other C-shaped link pairs have been engaged.

Figure 9:
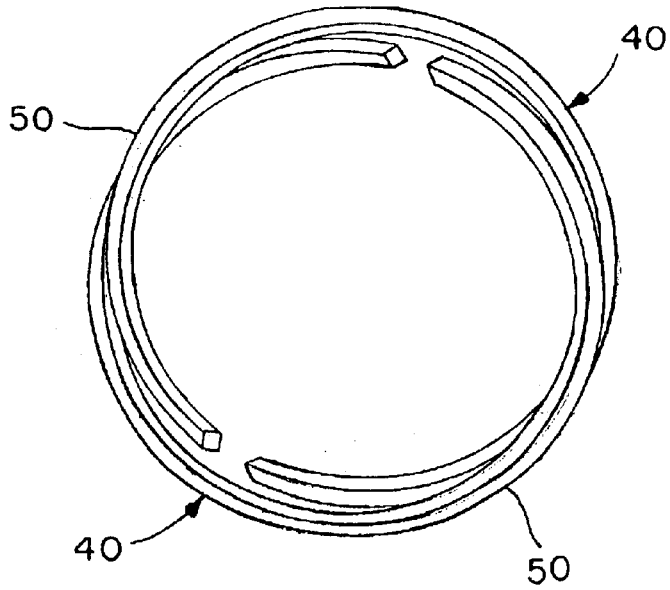
FIG. 9 is a Top plan view of two diamond crossection C-shaped links of this invention bonded as a pair.

FIG. 9 illustrates this method whereby two C-shaped links 40 are overlapped as shown and then bonded at edges 50 by any of a variety of techniques such as soldering, welding, brazing, or adhesive.

Figure 10:
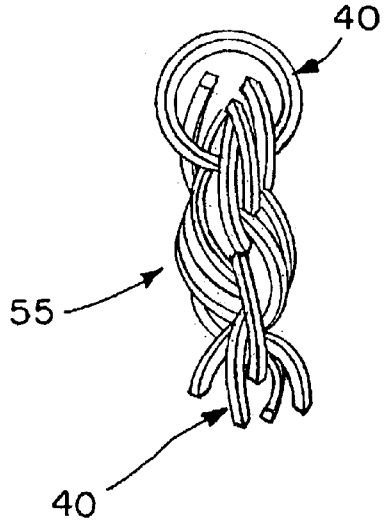
FIG. 10 is a Side elevational view detail of a section of an assembled rope chain using diamond crossection C-shaped links of this invention.
Figure 10A:
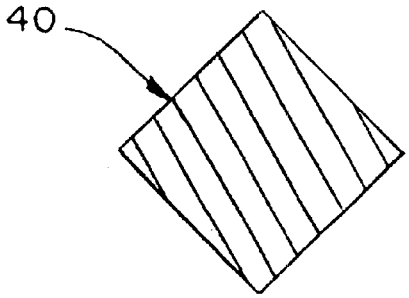
FIG. 10A is a Crossectional detail view of a link formed from square wire, as in FIG. 10.

FIG. 10 shows a section of rope chain 55 formed with C-shaped links 40. FIG. 10*a* is a close-up detail view of the diamond crossection of C-shaped link 40.

Figure 11:
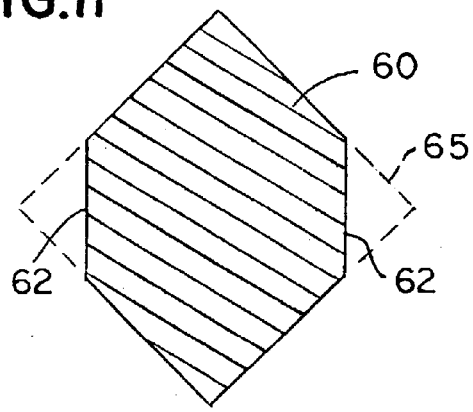
FIG. 11 is a crossectional view of a wire of an alternate embodiment with vertical flat facets.
Figure 12:
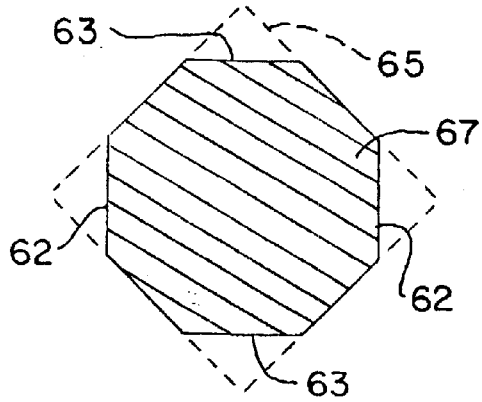
FIG. 12 is a crossectional view of a wire of a further alternate embodiment with both horizontal and vertical flat facets.
Figure 13:
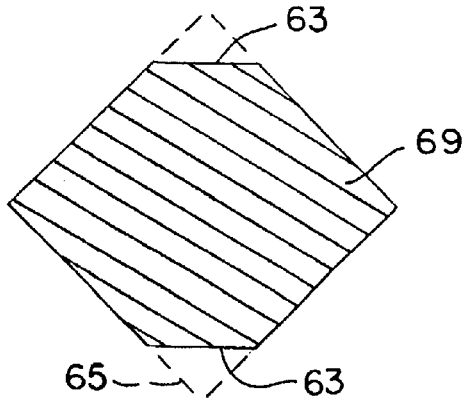
FIG. 13 is a crossectional view of a wire of yet another alternate embodiment with horizontal flat facets.

FIGS. 11, 12 and 13 show three crossections of an alternate embodiment of a wire with two or four facets oriented into a diamond configuration, to be used in making the C-shaped links of this invention.

For example, the crossection of wire 60 in FIG. 11 is formed by truncating two horizontal vertices of a wire having a diamond shape crossection, to form two vertical flat facets 62. Truncating can be done by shaving off the corners of wire 60 (as in FIG. 11), wire 67 (as in FIG. 12) or wire 69 (as in FIG. 13) before being bent.

The crossection of wire 67 in FIG. 12 has both horizontal facets 63 as well as vertical 62 facets.

The crossection of wire 69 in FIG. 13 has two horizontal facets 63. The crossections of wire 60 and wire 69 differ only by orientation.

All three of these shapes for wires 60, 67 and 69 fit within the respective original circumscribing diamond shaped outlines 65. Other crossectional shapes that abide by the latter restriction, such as having one to four facets or even grooves (not shown), replacing corresponding vertices of a diamond shaped wire, can be formed into C-shaped links, by the apparatus shown in the previous drawings, without modification, as long as the die grooves are sized to accept wire having a diamond crossectional shape, of a size corresponding to the circumscribing diamond shape.

Figure 14:
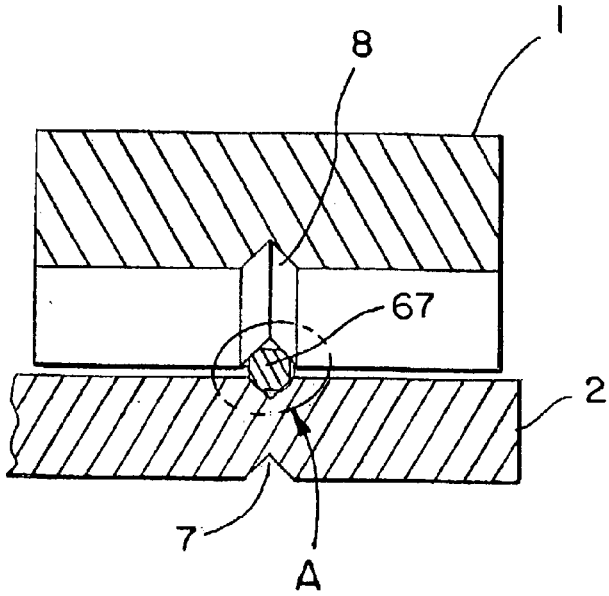
FIG. 14 is a crossectional view showing the internal groove in the fixed forming die grasping a wire of an alternate embodiment (similar to FIG. 3); and, FIG. 15 is a close-up detail view of a portion of FIG. 14 showing the wire crossection.
Figure 15:
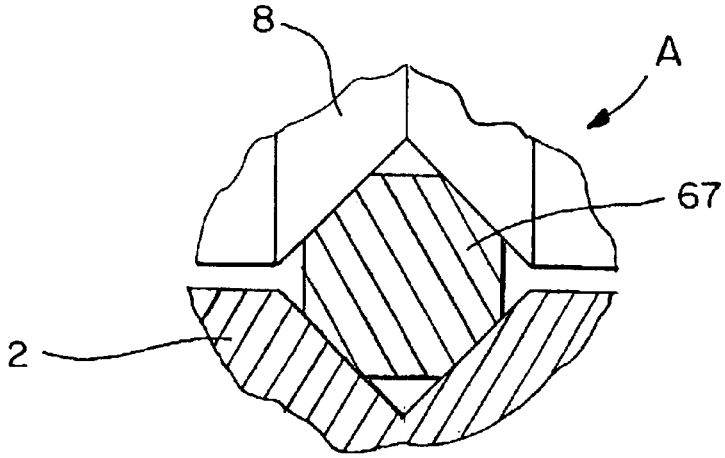

FIGS. 14 and 15 show how a crossection of wire 67 with four facets fits into, and is grasped by, inside contour 8 of fixed die 1 and groove 7 of mandrel 2. FIG. 15 is a close-up enlarged detail view of the area indicated by the Phantom ellipse "A" of FIG. 14.

For some crossections of wires, such as wire 60 and wire 69, orientation of the wire is very important to obtain the bending direction desired. A 90-degree rotation of wire 60 of FIG. 11 yields wire 69 of FIG. 13, for example, for the purpose of forming C-shaped links.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention.

We claim:

1. A machine for forming a C-shaped link from a wire having corners in cross section for use in making a jewelry chain comprising:

means for feeding said wire in and along a V-shaped groove formed in a surface of a stationary die, said V-shaped groove adapted to accommodate a first corner of said wire;

means for cutting said wire to form a predetermined length of said wire in said V-shaped groove, said surface of said die having a concave forming surface between ends of said predetermined length of said wire;

said concave forming surface having a shape including a corner to correspond with the first corner of said wire in said V-shaped groove;

means comprising a mandrel having a guidance groove matching a second corner of said wire on an opposite side of said wire from said first corner for pushing and bending said wire into said concave forming surface to form said wire into a U-shaped configuration; and means comprising a pair of movable die sections for closing said wire to form a C-shaped link surrounding said mandrel, said movable die sections having die V-shaped grooved surfaces shaped to correspond to said first corner of said wire, thereby forming a C-shaped link of said wire in which said second corner forms an inner circumference of said C-shaped link and said first corner forms an outer circumference of said C-shaped link.

2. The machine of claim 1 in which said wire is square in cross section so that said C-shaped link is diamond shaped.

3. The machine of claim 1 in which said wire is a polygon in cross section so that said C-shaped link is diamond shaped with facets.

4. Apparatus for removing a C-shaped link from a mandrel circular in cross section, said C-shaped link being in a groove surrounding said mandrel, comprising:

a mandrel housing having a hole in an end wall to receive one end of said mandrel, said hole having a diameter large enough to receive a first end of said mandrel and not large enough to accommodate said C-shaped link on said mandrel;

a pin at right angles to a length of said mandrel for contacting an end of said mandrel within said hole when said mandrel is inserted into said hole;

a spring within said hole contacting a side of said pin opposite to a side in contact with the first end of said mandrel; and an anvil for forcing the first end of said mandrel against said pin compressing said spring causing the end wall of said mandrel housing to pop said C-shaped link out of said groove in said mandrel, said spring at least partially ejecting said mandrel from said hole when said anvil is retracted.

5. The apparatus of claim 4 having a gripper mechanism to remove said C-shaped link from a second end of said mandrel after said C-shaped link is removed from said groove in said mandrel.

6. The apparatus of claim 4 in which a length of said mandrel extending from said groove to the second end of said mandrel is sufficiently short as to allow said C-shaped link when popped out of the groove in said mandrel to drop into a container for collecting the C-shaped link.

7. A method of making a jewelry chain from a plurality of C-shaped links formed from a wire having corners in cross section comprising the steps of:

feeding said wire in and along a V-shaped groove formed in a surface of a stationary die, said V-shaped groove adapted to accommodate a first corner of said wire;

cutting said wire to form a discrete predetermined length of said wire in said V-shaped groove, said surface of said die having a concave forming surface between ends of said predetermined length of said wire, said concave forming surface having a shape including a corner to correspond with the first corner of said wire in said V-shaped groove;

pushing and bending said wire into said concave forming surface using a mandrel having a guidance groove matching a second corner of said wire on an opposite side of said wire from said first corner to form said wire into a U-shaped configuration;

closing said wire to form a C-shaped link surrounding said mandrel using a pair of movable die sections, said movable die sections having die V-shaped grooved surfaces shaped to correspond to said first corner of said wire, thereby forming a C-shaped link of said wire in which said second corner forms an inner circumference of said C-shaped link and said first corner forms an outer circumference of said C-shaped link;

removing said C-shaped link from said mandrel;

moving successive segments along said V-shaped groove formed in said surface of said stationary die to produce a plurality of C-shaped links from the same wire; and combining said C-shaped links to form a jewelry chain.

8. The method as in claim 7, wherein, prior to feeding said wire, said wire is shaved to form at least one facet thereon.

9. The method as in claim 8, wherein, prior to feeding said wire, said wire is shaved to form a plurality of facets thereon.

10. The method of removing a C-shaped link from a mandrel circular in cross section, said C-shaped link being in a groove surrounding said mandrel, comprising the steps of:

inserting one end of said mandrel into a hole in an end wall of a mandrel housing, said hole having a diameter large enough to receive said mandrel and not large enough to accommodate said C-shaped link on said mandrel, a pin within said hole at right angles to a length of said mandrel for contacting an end of said mandrel within said hole when said mandrel is inserted into said hole, and a spring within said hole contacting a side of said pin opposite to a side in contact with said mandrel;

using an anvil to push said mandrel against said pin, compressing said spring and causing the end wall of said mandrel housing to pop said C-shaped link out of said groove in said mandrel, said spring at least partially ejecting said mandrel from said hole when said anvil is retracted; and removing said C-shaped link from one end of said mandrel.

11. The method of claim 10 in which said C-shaped link is removed from said mandrel by using a gripper to grab said C-shaped link and moving said C-shaped link past an end of said mandrel.

12. The method of claim 10 in which said C-shaped link is removed from said mandrel by dropping off one end of said mandrel when said C-shaped link is popped out of said groove.

13. A process forming a seamless C-shaped jewelry link made by a machine from square crossectional metal wire comprising the steps of:

providing a seamless metal wire having a square crossection, said wire having four straight longitudinally extending corner edges extending along a predetermined length of said wire;

said square wire being rotated onto a first corner edge of said four respective straight longitudinally extending corner edges and said rotated square wire being placed upon a mandrel, wherein said first corner edge tangentially contacts said mandrel;

said mandrel having a groove holding therein a portion of said first longitudinally extending corner edge of said square crossectional metal wire;

said machine further having a forming die, said forming die having a respective further groove holding therein a portion of a second opposite longitudinally extending edge of said square crossectional metal wire;

bending a section of said square crossectional metal wire over said mandrel, to form a C-shaped jewelry link, said formed C-shaped jewelry link being diamond shaped in cross section, said C-shaped jewelry link having an outer circumference being widest at a respective widest point width formed by an opposite pair of said four corner edges of said C-shaped jewelry link.

14. The process of forming said jewelry link by a machine as in claim 13 further comprising the step of removing said C-shaped jewelry link from between said forming die and said mandrel;

moving successive segments along said respective grooves formed in said mandrel and said forming die to produce a plurality of C-shaped jewelry links from square wire; and combining said C-shaped links to form a jewelry chain.

15. The process as in claim 13, wherein, prior to rotating said wire onto one of its respective straight longitudinally extending edges, said wire is shaved to form at least one facet thereon.

16. The process as in claim 15, wherein, prior to rotating said wire onto one of its respective straight longitudinally extending edges, said wire is shaved to form a plurality of facets thereon.

17. The process as in claim 13 wherein further rotation of said link onto said longitudinally extending corner edge results in respective widest points of said C-shaped link correspond to a common hypotenuse joining two equilateral triangles, forming said diamond crossectional width of said C-shaped link.

18. The process of forming said jewelry link as in claim 13 wherein said jewelry link is solid.

19. The process of forming said jewelry link as in claim 13 wherein said jewelry link is hollow.

* * * * *